United States Patent [19]

Buxmann

[11] 4,203,580

[45] May 20, 1980

[54] STATIC MIXER FOR THE PRODUCTION OF METAL ALLOYS

[75] Inventor: Kurt Buxmann, Sierre, Switzerland

[73] Assignee: Swiss Aluminium Ltd., Chippis, Switzerland

[21] Appl. No.: 20,367

[22] Filed: Mar. 14, 1979

Related U.S. Application Data

[62] Division of Ser. No. 901,708, May 1, 1978.

[30] Foreign Application Priority Data

Jun. 2, 1977 [CH] Switzerland ..... 6766/77

[51] Int. Cl.[2] ..... C21C 1/00

[52] U.S. Cl. ..... 266/216; 266/233

[58] Field of Search ..... 266/216, 233; 75/53, 75/60, 68 R

[56] References Cited

U.S. PATENT DOCUMENTS

| | | | |
|---|---|---|---|
| 3,528,799 | 9/1970 | Ramacciotti | 75/60 |
| 3,737,303 | 6/1973 | Blayden | 75/68 R |
| 4,054,275 | 10/1977 | Cole | 266/216 |

*Primary Examiner*—P. D. Rosenberg

*Attorney, Agent, or Firm*—Robert H. Bachman

[57] ABSTRACT

A process involving a static mixer for the continuous production of metal alloys is such that molten metal is passed through a filter bed of loose particulate material exposed to atmospheric pressure. The alloying addition is made to the metal via a proportioning and feed device as the metal enters the filter bed. As a result the alloy components are dissolved in the molten metal and, due to the repeated division and reuniting of the streams of charge in the bed, the alloying elements are mixed with the metal before leaving the mixing chamber. The degree of mixing can be changed by changing the size of particles in the granular bed.

11 Claims, 5 Drawing Figures

STATIC MIXER FOR THE PRODUCTION OF METAL ALLOYS

This is a Division, of application Ser. No. 901,708, filed May 1, 1978.

BACKGROUND OF THE INVENTION

The invention concerns a process for the continuous production of metal alloys.

The production of alloys in the foundry involves a number of technological requirements which can not be fully satisfied by the present state of the art. The product of the process should later satisfy high demands with respect to homogeneity, and should contain as little as possible of non-metallic impurities which can be picked up at various stages. During the whole of the time that alloy additions are being made, the device for making these additions is required to exhibit a calculated dosage accuracy of ±0.2 to 2%. Besides this there should be as little as possible loss of metal dure to dross formation and combustion of alloying elements. From the point of view of economy it is necessary that the process can be automated easily so that it can be operated with minimum time consumption, under the most favorable conditions of job hygiene, and with the minimum loss of material due to starting and stopping procedures.

In the present state of the art the problem of alloying is solved mainly by stirring, by which is to be understood the production of a relative movement between the two components to be mixed using mechanical forces where both components are in motion with respect to the stirring system and the mechanical forces can be produced by a moveable stirrer or by a gas being blown through the melt. If this mechanical stirring is carried out in a batch type process, there are a number of disadvantages experienced.

Mechanical stirring devices are relatively susceptible to wear and therefore involve high maintenance costs. In many furnace lines there is a shortage of space and so the mechanical stirring must be done by hand. Since the effectiveness of the process is then to a large extent dependent on the attention and care exerted by the individual foundry worker, and because the work itself is found to be unpleasant physiologically and gives rise to doubts with respect to job hygiene, wrong compositions are produced and unplanned delays in production procedure arise because of the need for alloy adjustments to be made. On the other hand, if the melt is stirred by passing a gas through it, the porous ceramic block needed for this must be built in to the melt container, or lances must be used, both devices being of the kind which are particularly susceptible to wear. Mechanical stirring, in particular by flushing the melt with a gas, causes additional dross to be formed, and in unfavorable cases this dross can be rich in alloying elements. In addition to the alloying elements which are purposefully added to the melt, mechanical stirring is responsible for the introduction of undesireable non-metallic inclusions in the form of oxides, for example, which become uniformly distributed throughout the melt. These inclusions give rise to problems of material quality both during and after further processing as they cause grey streaks, tool wear and foil porosity. Stirring in alloying elements mechanically also leads to crust formation at the furnace walls, which consequently increases maintenance costs. The most serious disadvantage is that, when alloying additions of elements such as Mn, Ti, Sr, Fe etc. are made by mechanical stirring, the required degree of homogeneity (efficiency of mixing) is not achieved, so that the longer route involving expensive master alloys has to be taken (see for example Aluminum Master Alloys DIN 1725 Sheet 3, June 1973; H. Nielsen (Hg) Aluminium-Taschenbuch, 13th edition, Dusseldorf, 1974, pages 12–14).

In the above mentioned mechanical stirring processes, the mixing action for the requisite relative movement is produced by moving stirring elements which transfer their energy to the components being mixed. The static mixer on the other hand employs a relative movement whereby fixed mixing elements act as obstacles, and the components to be mixed derive their energy of movement from a delivery facility which overcomes the pressure loss in the mixer. Static mixers representing the present state of the art comprise a system of tubes with a row of such static mixing elements which produce the mixing effect by repeated division and displacement of the component streams. Such a static mixer can be characterized by the homogeneity (efficiency of mixing) of the mixed product, the pressure loss in the melt container system and by the considerable heat transfer which possibly occurs (see Bruenemann/John, Chemie-Ing.-Technik, 43 (1971), 348, and with particular reference to heat transfer J. Gomori, Chemie-Ing.-Technik, 49 (1977), 39–40).

Static mixers are especially suitable for the continuous mixing of very viscous or aggressive fluids, either mixing them together or mixing with solids. They have however proved to be particularly good in the special field of mixing gas streams, for example in the technology of air conditioning, in the centers of hot and cold testing facilities, and in plants for drying a wide variety of products (J. Gomori, Static mixing of gas streams, Chemie-Ing.-Technik, 49 (1977), 39–40). The present state of the art is such that the stationary elements split or divide up the liquid or gas streams, divert the distributary streams and unite them again, as a result of which layers of material of changing composition are produced, their number increasing with the number of displacement elements employed. Theoretically, by means of appropriate choice of element and in particular by maximizing their number within temporary limiting conditions, any required degree of mixing can be achieved.

Static mixers representing the present state of the art have no moving parts; the pressure loss which the melt suffers in the mixer has to be overcome by the facility delivering the melt. The requisite work of mixing is then-besides other things-provided by the reduction in the kinetic energy of the stream of material which expresses itself by the mixture suffering a corresponding loss of pressure and velocity (J. Gomori, ibid, O. A. Pattison, Motionless Inline Mixers, Chem. Eng., 1969, (5), following p. 94; T. Bor, The Static Mixer as a Chemical Reactor, Brit. Chem. Eng. 1971, pages 610–612; H. Bruenemann/G. John, Efficiency of Mixing and Pressure Losses in Static Mixers of Various Design, Chemie-Ing.-Technik 43 (1971), pages 348–356; Ullmann's Encyclopaedia of Techn. Chem. 4.A. 1972, Vol. 2, follow p. 267).

Among the disclosed versions of static mixers representing the state of the art there are some which are not suitable for the preparation of alloys as the transport of molten metals in closed pipe systems presents additional technical problems. If use is made of a mixer with closed flow channels, in which the pressure at the entry to the mixer is produced by conventional pumps and the connection between the flow channels and the displacement elements is permanent, then there is a danger that the device will become blocked dure to the displacement elements being permanently anchored in the through-flow channel. Maximizing the number of displacement elements, a feature which seems desireable to optimize the efficiency of mixing actually exacerbates this situation considerably (US-PS 2 894 732 of Shell Co., 3 051 452, 3 051 453 and 3 182 965, 3 206 178 of American Enka Co., US-PS 3 195 865 of the Dow Badische Co.).

In the mixer with closed flow channels there is a large pressure loss as a result of the friction between the deflection elements and the components being mixed. The more displacement elements there are in the system the more pronounced is the pressure drop between the entry and exit points in the mixer. In a favorable case the pressure drop in the static mixer is four times that produced by a comparable empty flow channel (O. A. Pattison ibid p. 95), with the result that the pressure drop has to be overcome by a suitable delivery system.

In mixers with closed flow channels and permanently installed displacement elements the latter are not readily accessible and are therefore difficult to clean mechanically. This can lead to a greater danger of corrosion and therefore to a shorter service life. If the mixture contains expensive ingredients then for the same reason the resultant loss of material becomes an important factor. Such a loss is greater the more displacement elements in the system, the desired number of elements being determined by other considerations.

Finally, the normal design of static mixer requires a relatively complicated geometry of displacement and mixing elements in order to avoid so called tunneling of the mixture components. By "tunneling" here is to be understood coarse inhomogeneities in the product in the form of a breakthrough of an individual component of the mixture (Bruenemann/John, ibid p. 352). In one of the common versions of the static mixture this problem has led to the practice that one or more alternating left and right hand displacement elements are in the form of perforated sheet and are arranged in series one behind the other (O. A. Pattison, ibid p. 95). The version of mixer described in U.S. Pat. No. 3,195,865 contains mixing and displacement elements of a particularly complicated geometry. Such complicated geometrical arrangements incur high assembly costs which are raised further by the fact that the mechanical properties of the junction between displacement element and flow channel have to meet high standards in order that compensation can be made for the relatively large pressure difference.

SUMMARY OF THE INVENTION

The object of the present invention was to adapt the principle of the static mixer for the special field of producing alloys from metallic melts and solid alloy additions, and to avoid as far as possible the disadvantages of the methods representing the present state of the art.

This object was fulfilled in that a metallic melt is allowed to pass through a through-flow container exposed to atmospheric pressure and filled with a loose, exchangeable bed of granular material, i.e., the particles are contacting under the influence of its metallostatic pressure, and that the alloying addition is made to the flowing metallic melt by means of a mechanical proportioning and feeding device, that as a result the alloy addition is dissolved in the melt, that the components to be mixed are divided and reunited again many times by flowing through the bed of granular particles, i.e., a tortuous path is provided, which serve as mixing and displacement elements, and leave the container intimately mixed, and that the degree of mixing can be changed by changing the size of the granular particles of the bed.

The principle of the static mixer is modified in a specific manner in the process of the invention to allow the production of alloys. This entails, in the first instance, the mixing chamber being exposed to atmospheric pressure and the work of mixing being provided by the difference in the metallostatic pressure of the melt between points of entry and exit in the through-flow container. A particular advantage of the process of the invention is that the obstacles to flow, which in the present state of the art are permanently connected to the mixing chamber, are exchangeable in the device used to carry out the process of invention, a feature which ensures that cleaning of the mixing aggregate is easy and blockage of the device by solidified metal is less of a disadvantage than in a device with permanently installed obstacles to flow. A further basic feature of the invention is that the degree of mixing can be influenced directly by choosing the appropriate particle size for the mixer bed, which means that consideration can be given to the requirements of each individual case.

In contrast to the processes which represent the present state of the art and make use of manual charge-type mixing, the process of the invention has the advantage that the quality of the alloy no longer depends on the efficiency of the foundry worker trusted with the manual mixing of the melt, consequently making it possible to have a more constant concentration of the alloying elements in the final melt. Since there is no mechanical stirring, the amount of dross formed is much less than when the alloys are produced in charges.

In contrast to the charge-wise mixing of the processes representing the state of the art the process of the invention has the advantage that also alloying elements which are difficult to dissolve, such as manganese or titanium, can be added in the form of the pure metal without having to employ the longer route via master alloys. This is particularly so when the charge is an aluminum melt in accordance with the invention laid down in U.S. Pat. No. 4,138,246, where the melt is taken at a temperature in excess of 800° C. directly from the electrolytic cell. The process of the invention also reduces the danger of impurities being introduced into the melt-and therefore the end product-by manual stirring either with the tool used for stirring or by damage to the furnace wall; such impurities can diminish the quality of the product and, depending on the circumstances, can lead to considerable financial penalties.

The process can be modified in that a weighed amount of alloying element can be placed on the granular material of the mixer bed before pouring the melt through it. In another version the granular material of the mixer bed and the weighted amount of alloying element are mixed and then placed in the through-flow container, and the melt is then allowed to flow through this mixture. The alloying addition can also be a mixture of alloying elements, the latter being extracted by the melt flowing through the bed.

BRIEF DESCRIPTION OF THE DRAWINGS

Various exemplified embodiments of the invention are shown in the figures which show.

DETAILED DESCRIPTION

Figure 1:
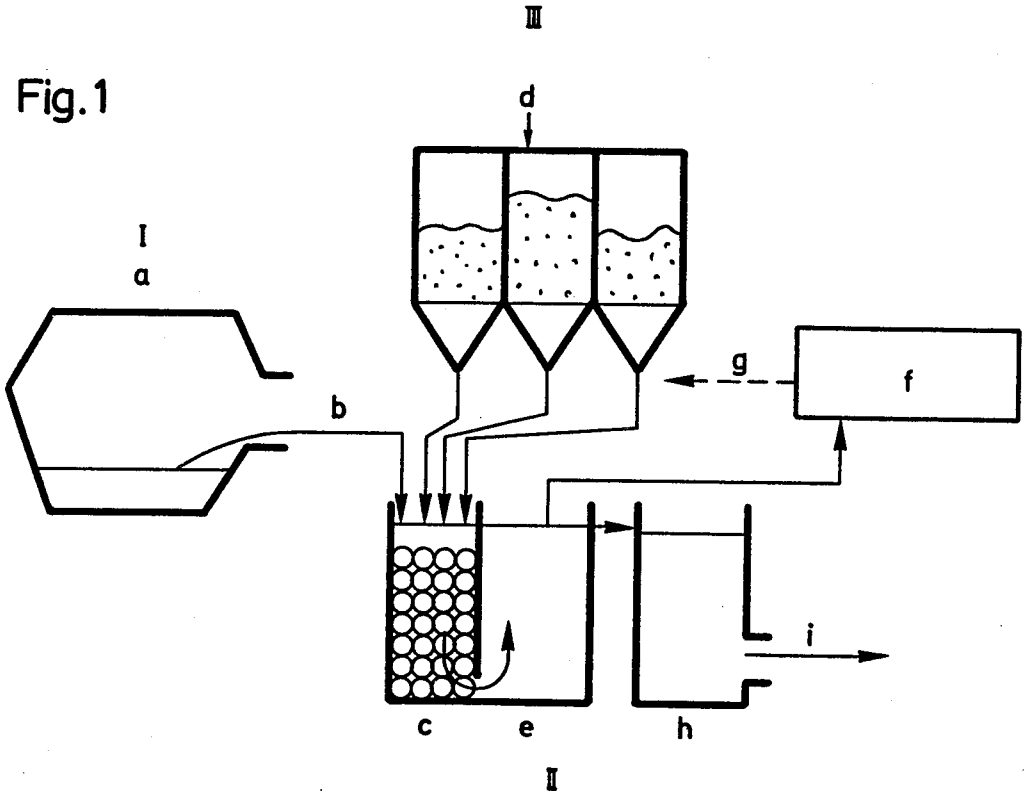
FIG. 1: A flow diagram of the process for the production of metal alloys using a static mixer.

The schematic description of the process shown by the flow diagram in FIG. 1 comprises the three parts which make up the mixer unit viz., the furnace (I), the static mixer (II) in a narrower sense, and the proportioning and feeding device for adding alloying components (III). The unalloyed molten metal (b) is transferred from the holding furnace (a) to the filter chamber (c) of the mixer which is filled with a loose particulate bed, where it is mixed with the continuously fed alloying elements. The melt product flows from the filter chamber (c) into a holding chamber (e), where samples of the melt can be taken for analysis (f). The results of the analyses determine whether the dosage of alloying elements has to be altered (as indicated by the arrow (g). Finally the resultant alloy melt can be collected in a second holding chamber (h), before being transferred to the caster (i).

Figure 2:
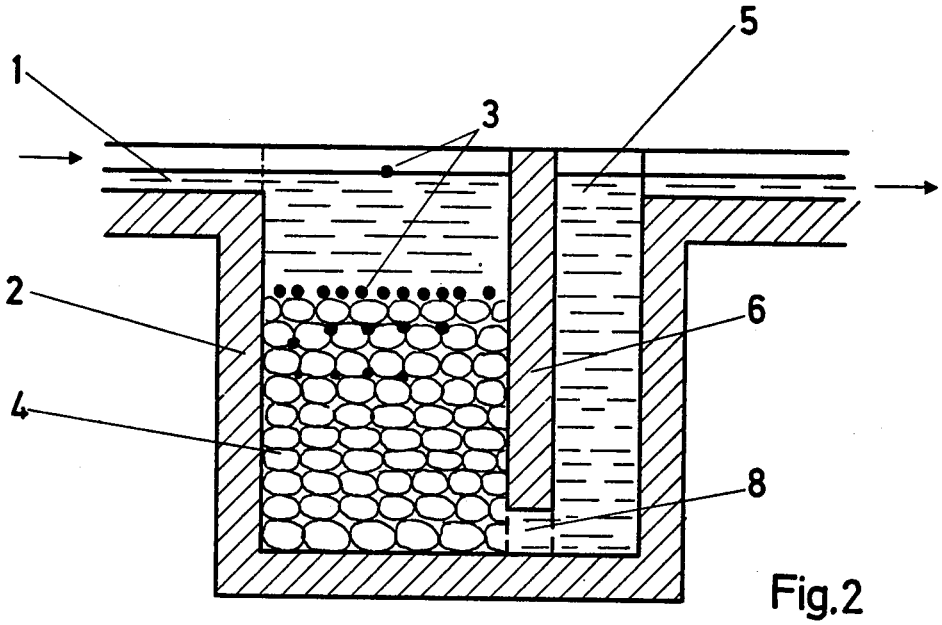
FIG. 2: A cross section through a mixer for producing alloys and having an in-built holding chamber.
Figure 3:
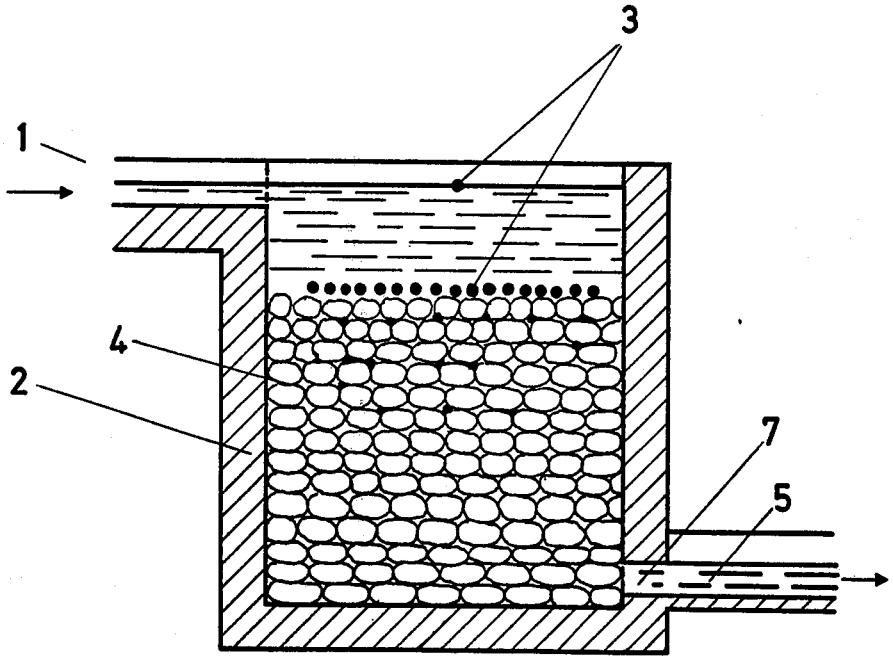
FIG. 3: A cross section through a static mixer for producing alloys, in which the entry of the melt and the exit for the alloy are at different levels.

Two exemplified embodiments of the mixing chamber of the invention are shown schematically in FIGS. 2 and 3. These permit the following process to be carried out: The unalloyed molten metal 1,-preferably an aluminum melt which, for example as in U.S. Pat. No. 4,138,246, can be taken from the electrolytic reduction cell at a temperature of over 800° C.-flows first into a ceramic through-flow container 2 filled with a loose bed of granular material 4. This particulate bed can be changed after use, thus ensuring that the mixing chamber is cleaned. The appropriate choice of particle size of granular material allows the degree of mixing of the alloy to be varied in accordance with the needs of each, individual case.

Materials which can be considered for the granular bed are for example corundum, zirconium oxide, silicates i.e. quartz, and combinations of these materials. With regard to particle size, it has been found useful to obtain specific particle diameters by sieving and to use specific diameters instead of mixtures with a Gaussian distribution of particle diameter. For example granular corundum particles of maximum diameter 5–6 cm have proved to be of value in the production of aluminum alloys. To obtain a constant degree of mixing it is recommended to make the bed up out of a base material consisting of particles of some inert material such as corundum, for example, of 5–6 cm in diameter and to combine this with additions as follows: If the alloying material being added is one which is difficult to alloy with the melt, then it can be advantageous to provide the bed with a 20–30 cm thick layer of a material of finer particle size e.g. quartz, where at the elevated temperature the finer material is smaller than the particles of the alloying addition. The additives which are difficult to dissolve in the melt are then held back in the upper part of the bed, and the alloying material is extracted from the particles, thus making it possible to obtain high concentrations of additions which are difficult to alloy with the melt.

Good results can also be obtained by using particulate bed material of two different but specific particle sizes distributed throughout the bed. The ratio of particle diameters should then be at least 6:1. In this connection it has been found useful to choose for the smaller diameter particle a material of lower conductivity than the larger diameter particle.

Figure 4:
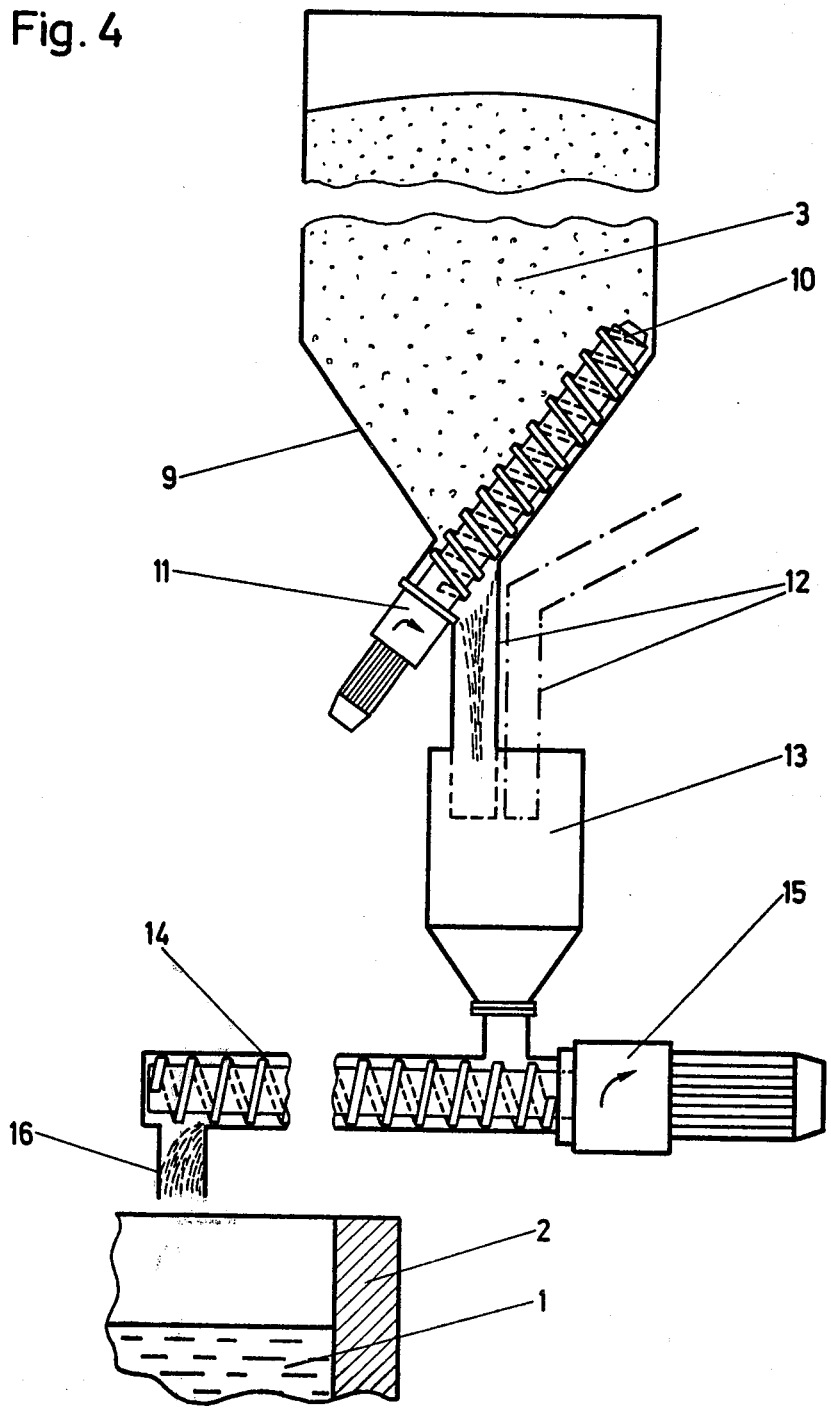
FIGS. 4–5: Various forms of proportioning devices for feeding various alloying materials into the static mixer.
Figure 5:
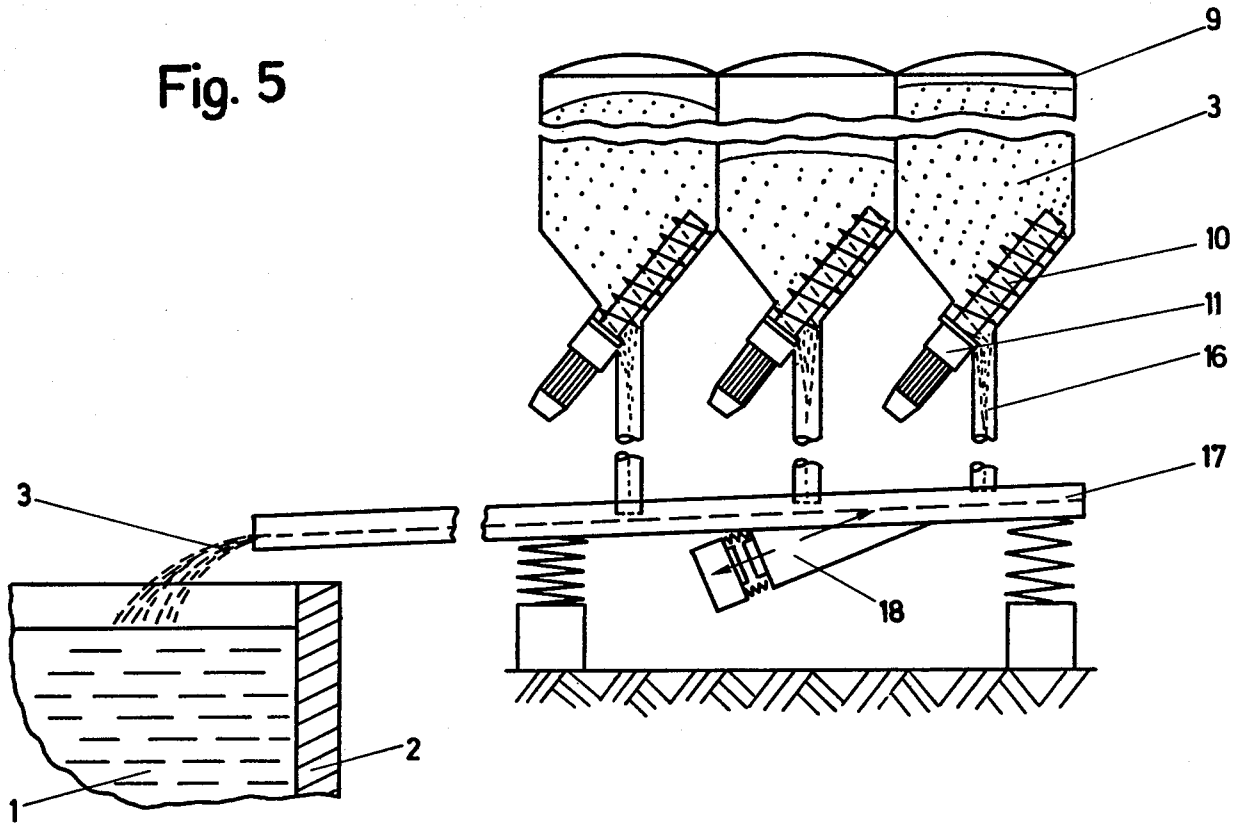

The alloying component 3 is introduced in fine particulate form into the melt via one of the proportioning devices shown in FIGS. 4 and 5, or as particulate material in the mixing chamber whereby, if there is a number of components to be added, the proportioning device already provides a certain degree of pre-mixing. It has been found useful in this respect to make the alloying addition in the form of granules with the largest particle diameter between 0.5 and 1 cm.

The rigid bed 4 in the through-flow container 2 serves as an obstacle to flow in this set up, the degree of mixing it provides being variable by choosing the appropriate particle size. In order to prevent combustion and formation of dross, the components which are not fully mixed can be protected from the oxygen in the air by a lid which touches the surface of the melt. The device shown in FIGS. 2 and 3 appears therefore to be suitable above all for adding those metals which have such a slow rate of dissolution that in the present state of the art they have to be added in the form of master alloys (Mn, Cr, Ti etc.), those which give difficulty because of their tendency to burn off or vaporize while being added to the melt (Mn, Zn), or those which are more economic or can be obtained with better quality in particulate form (e.g. Si). After mixing by passing through this filter bed the alloy 5 leaves the mixing chamber, either after it has been collected in a holding chamber which is separated from the mixing chamber by a dividing wall 6 which has one or more openings 8 in it (FIG. 2), or else through an opening at the base of the container (FIG. 3). The alloyed melt can then be led into a second holding chamber (FIG. 1,h) and from there into the caster. Samples for analysis can be taken both from the riser chamber in the arrangement shown in FIG. 2 and from the holding chamber (FIG. 1,h).

Normally the alloy additions are introduced in a granular form which is difficult to pour and produces medium to high degrees of wear, characteristics which have to be considered when designing the means for making these additions. The facility for making alloying additions is required to give a calculated accuracy of ±0.2–2% over a period of one minute, but in practice efforts are made to keep the fluctuations below ±1%.

In the device shown in FIG. 4 the alloying elements are contained in one or more silos 9, which have a rotating screw feed facility 10 projecting down into the conical part and driven by an electric motor 11. If the screw is rotated in one direction then it provides premixing of the various granular components, if this is required. If the screw is rotated in the other direction then it forceably removes the alloying components from the silo, at the same time providing fine regulation and constant feed of the granular material or different granular materials, which are then transferred via outlet pipe 12 to a funnel 13 which is arranged so that it can accept alloying material from a number of outlet pipes. The screw feed facility 10 in the conical run out of the silo 9 also makes it possible to use granular material which has been baked or compacted by external forces or conditions, to break up this material and convert it again to a pourable state suitable for adding to the melt in specific amounts. The funnel 13 tapers down to a horizontal screw feed facility 14 which is driven by an electric motor 15. The process of transfer in this screw feed facility causes the various alloying elements to be pre-mixed by an appropriate degree, before being fed via pipe 16 to the surface of the molten metal flowing into the mixer bed. In order to avoid oxidation by the oxygen in the air, and also to prevent large amounts of dross from forming, the height of free fall (16,1) is minimized as much as is possible, and if desired, the surface of the in-flowing melt is covered by a sheet (not shown in FIGS. 4 and 5).

In the device in FIG. 5 for adding measured amounts of alloying constituents, the latter are contained in a plurality of silos 9 with rotating screw feed facilities 10 projecting into their run-out cones as shown in FIG. 4. The outlet pipes of these silos connect up with an inclined feed pipe 17 which is supported by springs and which can be made to vibrate with variable frequency by means of a magnetic pulsator 18. By choosing a suitable angle of inclination for the feed pipe 17 and by selecting the frequency of excitation, the granular alloying material moves along the pipe by a sliding and jumping action. A somewhat thicker layer of granular material behaves approximately like a unified lump which moves along the pipe like a plastic mass. This method of conveyance causes pre-mixing of the various alloying constituents before they reach the molten metal 1 and thus the mixing chamber 2 where the actual alloying takes place. A rotating endless belt or chain conveyor can be employed instead of a vibrating feed pipe, but with less pre-mixing of the alloying constituents.

The process is controlled in such a way that the individual drives (electric motors 11 and 15, and magnet drive 18) for the proportioning and feed devices are regulated by means of an electronic device such as a micro-processor. The input data for this micro-processor can be the nominal or actual composition of the alloy, the latter values being obtained by periodic sampling from the holding chamber (FIG. 1, II-h). Other input values which can be used are the analyses of the metal in the furnace, the analysis of the master alloy used, and/or the number of billets, ingot weight and casting speed.

In the present state of the art there is a delay of some minutes between taking the sample from the holding chamber (FIG. 1, II-h) and printing the results of the analysis. Now, by using a suitable computerized analyzing facility, most of the analytical values mentioned can be used to control the proportioning device directly, thus replacing the manual input of this data into the micro-processor. Such a process which can be controlled in this way appears to be particularly suitable for use with continuous casting facilities which are designed for the production of cast strip, or for horizontal casting.

In an example involving a production run, magnesium in the form of individual pieces of up to 100 g was fed into a mixing chamber of the kind shown in FIG. 2, and the production unit run at 6 t aluminum melt per hour with the temperature of the aluminum as it entered the mixer at 700° C. The required calculated accuracy of the dosage of alloying addition was ±0.2–2% over one hour with a mixer which had a volume of 0.5 $m^3$ when empty and approx. 0.2 $m^3$ when filled with granular bed material. The homogeneity required of the alloyed product was ±5% of the weight of the alloying addition in the final product over more than 95% of the total production time, excluding the time for starting up and stopping.

What is claimed is:

1. A static mixer for the production of metal alloys which comprises a through-flow container which stands under atmospheric pressure and through which molten metal is passed, and a mechanical proportioning and feed device in communication with said container for making additions of alloying material thereto for dissolving same in the melt, wherein said through-flow container contains an obstacle to the flow of molten metal in the form of an exchangeable bed of head resistant, inert granular particles, said particles filling at least a portion of said container to provide a tortuous path therethrough whereby the components to be mixed are repeatedly divided and united again by said particles as the melt flows through the bed wherein the degree of mixing can be changed by altering the size of the particles, wherein the melt leaves the container intimately mixed.

2. A static mixer according to claim 1 wherein said through-flow container comprises a single chamber substantially filled with granular material, and the molten metal enters and leaves said chamber at different levels.

3. A static mixer according to claim 1 including a holding chamber adjacent said through-flow container and communicating therewith so that the molten metal is passed from said through-flow container to said holding chamber.

4. A static mixer according to claim 1 wherein the granular particles are selected from the group consisting of corundum, zirconium oxide, carbon, silicates and mixtures thereof.

5. A static mixer according to claim 1 wherein said granular particles have a diameter not less than 5 cm and not more than 6 cm.

6. A static mixer according to claim 1 wherein the granular particles are of two specific particle diameters the ratio of which is at least 6:1 and the thermal conductivity of the material with the smaller diameter is smaller than that of the material with the larger diameter.

7. A static mixer according to claim 1 wherein said bed is made up of particles of two different sizes with the smaller granules being at the top and holding back the alloying additions.

8. A static mixer according to claim 1 wherein the proportioning and feed device comprises at least one silo having a run out cone extending therefrom and including a screw feed device driven by an electric motor built into said run out cone.

9. A static mixer according to claim 1 wherein said proportioning and feed device includes a screw feed device which runs on a horizontal axis and has an inlet pipe and which serves to pre-mix the various alloying elements before they are fed to the molten metal.

10. A static mixer according to claim 1 wherein said proportioning and feed device is provided with an inclined pipe which is mounted on springs and can be made to vibrate by means of a magnetic pulsator and serves to pre-mix the various alloying additions before they are fed to the molten metal.

11. A static mixer according to claim 1 wherein said molten metal is aluminum.

* * * * *